United States Patent [19]

Billingsley et al.

[11] Patent Number: 4,563,957

[45] Date of Patent: Jan. 14, 1986

[54] CAR BOTTOM-TO-SIDE SILL CONNECTION

[75] Inventors: Robert H. Billingsley; George Reed, both of St. Louis; Arnold Schlobohm, Ballwin, all of Mo.

[73] Assignee: ACF Industries, Incorporated, Earth City, Mo.

[21] Appl. No.: 467,099

[22] Filed: Feb. 16, 1983

[51] Int. Cl.[4] ..... B61D 17/00; B61D 5/00; B61D 7/00

[52] U.S. Cl. ..... 105/418; 105/413; 105/247

[58] Field of Search ..... 105/413–414, 105/418, 404, 244, 247, 248

[56] References Cited

U.S. PATENT DOCUMENTS

| | | | |
|---|---|---|---|
| 2,035,113 | 3/1936 | Blomberg | 105/418 |
| 2,286,954 | 6/1942 | Clarke et al. | 105/418 |
| 2,333,223 | 11/1943 | Williams | 105/418 |
| 2,642,817 | 6/1953 | Goldberg | 105/413 X |
| 2,814,997 | 12/1957 | Deam | 105/418 |
| 3,035,531 | 5/1962 | Leriche | 105/118 X |
| 3,641,943 | 2/1972 | O'Neill | 105/418 |
| 3,868,914 | 3/1974 | Przybylinski | 105/421 X |

*Primary Examiner*—Robert B. Reeves
*Assistant Examiner*—Russell D. Stormer
*Attorney, Agent, or Firm*—Polster, Polster and Lucchesi

[57] ABSTRACT

In accordance with the present invention a casting (60) is provided to connect the car bottom (40) to the side sill (10). A connecting plate (46) is provided to attach the casting (60) to the side sill (10). Preferably the side sill (10) is generally hat shaped and is reinforced with an angle (26) at the end portion of the car which supports the shear plate (34).

7 Claims, 7 Drawing Figures

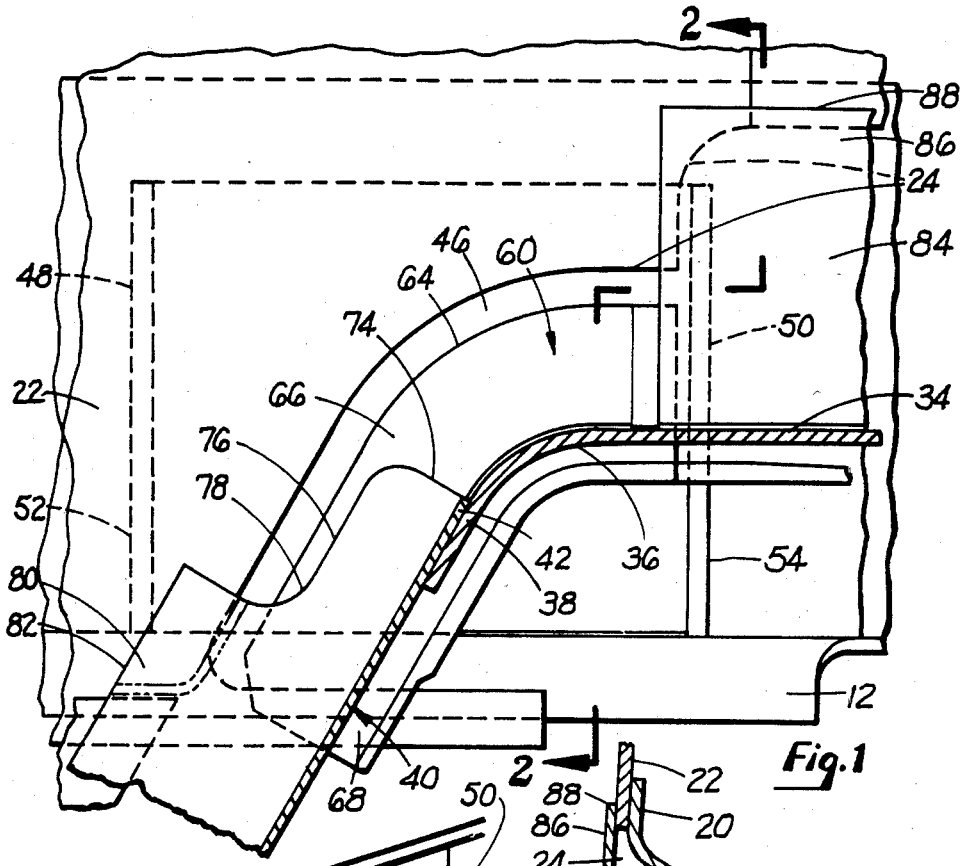
Fig. 1
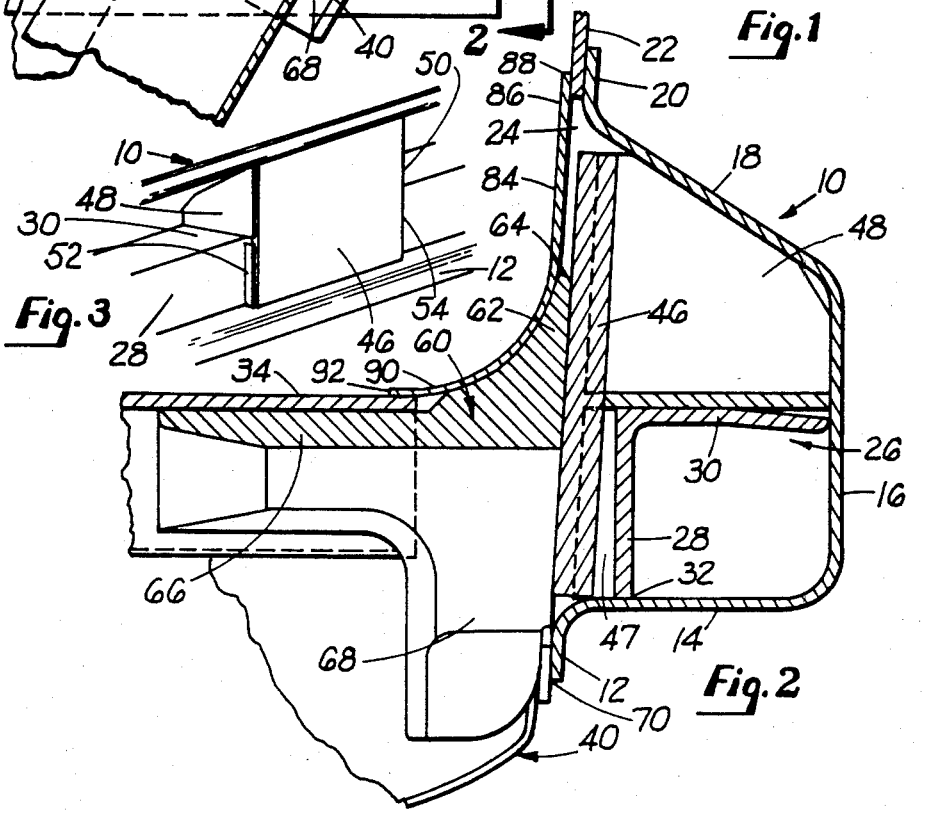
Fig. 2
Fig. 3

CAR BOTTOM-TO-SIDE SILL CONNECTION

BACKGROUND OF THE INVENTION

In stub sill railway hopper cars it has been difficult to provide a satisfactory arrangement for connecting the car bottom to the side sill at or near the end of the stub sill.

For example, in one stub sill open top hopper car the circular, reinforced bottom was directly connected to the side sill near the end of the shear plate. In many instances rewelding and insertion of connecting plates was required to provide an integral arrangement for transmitting the car bottom load into the side sill.

SUMMARY OF THE INVENTION

A car bottom to side sill connection is provided in a railway car at the inner end portion of a shear plate which extends outwardly from either end of the car. A connecting plate extends vertically between upper and lower portions of the side sill. A casting is welded to this vertical plate which extends generally inwardly of the car and downwardly. The shear plate is coped to receive this casting. Both the shear plate and the car bottom are welded to this casting. In addition, in the lateral mid-portion of the car, away from the casting, the car bottom is welded to a downwardly extending portion of the shear plate.

Preferably, at the end of the car the shear plate extends into the side sill and longitudinally extending support means are provided in the side sill to support the shear plate. In a preferred embodiment this shear plate support means comprises an angle.

The combination of the connecting plate welded to the side sill and the casting extending inwardly to which is welded the car bottom and the shear plate, provides an effective load path for transferring the lading loads and train action applied to the car bottom and shear plate into the side sill adjacent to the inner end of the shear plate.

IN THE DRAWINGS

FIG. 1 is an inside elevation view.

FIG. 2 is an end view partly in section, looking in the direction of the arrows along the line 2—2 in FIG. 1, illustrating the juncture of the car bottom to the shear plate, and the casting of the present invention.

FIG. 3 is a detail perspective view illustrating the connecting plate located within the side sill according to the present invention.

DESCRIPTION OF PREFERRED EMBODIMENTS

Figure 4:
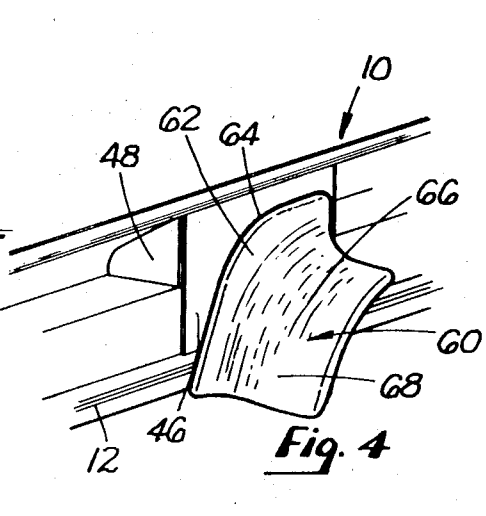
FIG. 4 is a detail perspective view illustrating the attachment of the casting to the connecting plate in accordance with the present invention.
Figure 5:
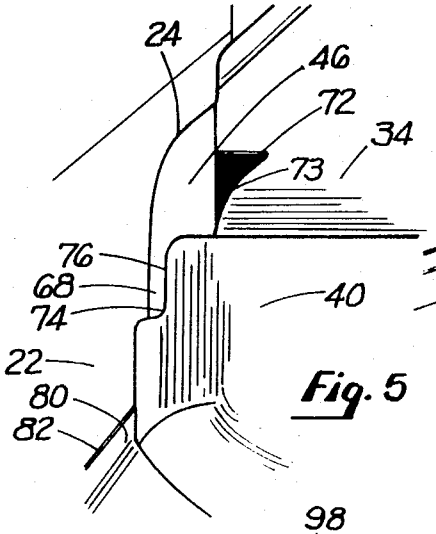
FIG. 5 is a detail perspective view without the casting, illustrating the slot in the shear plate and attachment of the shear plate to the car bottom.

In the present invention a side sill 10 includes a lower flange portion 12, a lower horizontally extending web portion 14, a vertical portion 16, an upper inclined web portion 18, and an upper flange portion 20. A railway car side 22 is connected to flange portion 20 by welding. The side is cut away at 24.

An angle indicated generally at 26 including a vertical leg 28 and a horizontal leg 30 is welded to web portion 14 at 32. Horizontal leg 30 supports a shear plate 34 which extends from the end of the car inwardly to a point 36 (FIG. 1) where it is bent downwardly at 38, and the car bottom indicated generally at 40 including an upper end 42 which is welded to the shear plate end portion 38.

Located within the side sill 10 is a connecting plate 46 (FIGS. 2 & 4) which extends from and is welded to web portion 14 over angle 28, and extends further to inclined portion 18 and is welded to web portion 18. Closure plates 48 and 50 are provided which support connecting plate 46 and which are shaped such as to engage and be welded to side sill web 18 and leg 30 of angle 26. It will be noted from FIG. 2 that plate 46 is spaced from angle leg 28 a suitable distance 47 such as 15/16". Plates 48 and 50 include extensions 52 and 54 which extend between the upper surface of angle leg 28 and plate 46 to support the same. Alternatively, members 52 and 54 may be separate pieces.

A casting indicated generally at 60 is placed upon and is welded to plate 46 (FIG. 4). Casting 60 includes a base portion 62 which is welded at 64 to plate 46. Casting 60 further includes a body portion 66 which extends outwardly from base portion 62. Casting 60 further includes a downwardly extending portion 68 which is welded at 70 to side sill flange portion 12, and to car bottom 40.

The combination of the side sill 10, the angle 26, and the plates 48 and 50 are conveniently provided as a subassembly. Shear plate 34 is coped at 72 to avoid interference with plate 46 and its support plates 48 and 50. The inner edge 73 of coped portion 72 is welded to the casting as indicated at **73*a*. The shear plate 34 may, however, be welded to a pair of laterally spaced side sill assemblies 10**.

As mentioned above, the car body side 22 is coped at 24 to allow for attachment of the casting 60 to the plate 46.

Figure 6:
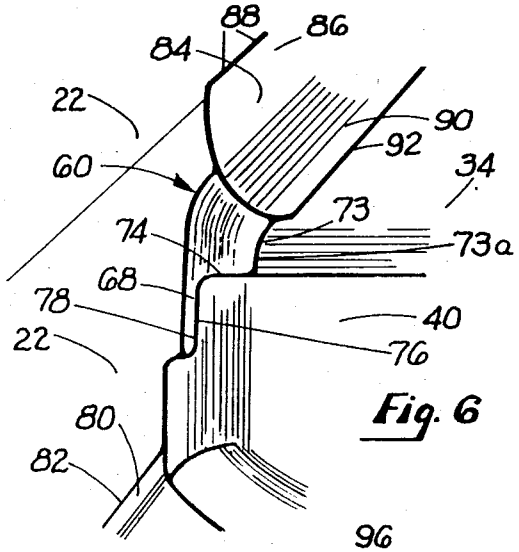
FIG. 6 is a detail perspective view illustrating the casting in place, and welding a closure plate in place between the shear plate and the car body side.
Figure 7:
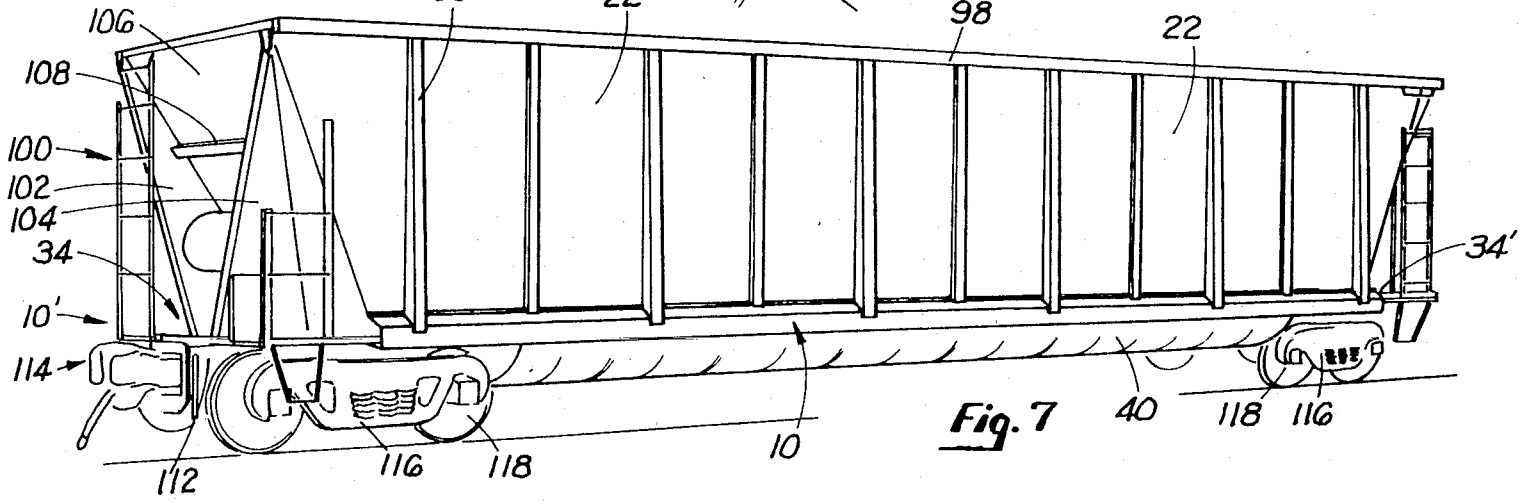
FIG. 7 is a perspective view illustrating an embodiment of the present invention directed to an open top hopper car.

As shown in FIG. 6, the bottom 40 is welded at 74 to the downwardly extending portion 68 of the casting 60. In addition, the bottom 40 is coped at 76 to allow for a further weld 78 to the casting 68. In addition, the car bottom 40 includes an upwardly extending portion 80 which is welded to the side sheet 22 along a weld line 82.

Finally, as shown in FIG. 6, a closure plate 84 is welded to the shear plate 34 and to the car body side 22. The closure plate 84 includes an upper flange portion 86 which is welded to the car body along a line 88 and a lower flange portion 90 which is welded to the shear plate along the weld line 92.

It will be apparent to those skilled in the art that combination of the casting 60 and the support plate 46 located upon the side sill provides a very effective arrangement for transferring the loads between the car bottom 40 and the side sill 10. Moreover, the casting 60 provides effective welding surfaces to attach both the car bottom 40 and the shear plate 34 to the casting. Also, the plate 46 with its reinforcements 48 and 50 provides an effective means of transmitting the load applied to the casting 60 to the side sill.

It will also be apparent to those skilled in the art that laterally spaced side sills 10 and 10' extend the full length of the car. At each end of the car are located shear plates 34 and 34'. Relative to each of these shear plates, castings 60 are located adjacent the juncture of the bottom 40 with respective shear plates 34 and 34'. Thus a total of four castings 60 will be provided per car, and a total of four connecting plates 46 will be required. Each connecting plate will require a pair of support plates 48 and 50.

Externally of the car the side sheet 22 is provided with reinforcements 96 extending from the side sill 10 up to the top plate 98. The end structure indicated generally at 100 includes a pair of diagonal plates 102 and 104 which extend from an inclined end slope sheet 106, downwardly to the shear plate 34. One or more transverse reinforcements 108 may also be provided.

The shear plate is welded to a stub sill 112 containing a conventional coupler 114. The car body is supported by a conventional truck 116, including a plurality of wheels 118, and a center plate (not shown) which connects the car body to the truck.

It has been found with the car bottom-to-side sill connection of the present invention that the lading loads and train action loads applied to the car bottom and shear plate are effectively transferred into the side sill and little or no handfitting is required. While member 60 has been described as a casting, it is within the perview of the present invention to utilize a fabricated member.

Also, it might be possible to utilize a casting for the combination of connecting plate 46 and supports 50 and 52.

Moreover, it might be possible to form a single casting including connecting member 46, support plates 48 and 50, and member 60.

We claim:

1. In a center stub sill railroad car having, at each end thereof, a center stub sill extending in longitudinal direction of the car along the centerline thereof, a pair of spaced side sills at the lower margin of the car and extending lengthwise of the car, each of said side sills being generally channel-shaped in cross section with the open face of each of said side sills facing generally inwardly of the car, a shear plate at each end of the car connected to a respective said center stub sill and to said side sills for transferring longitudinal train loads therebetween, a side plate extending upwardly from each of said side wills forming a respective side of said car, and a bottom extending inwardly between said side sills forming the bottom of the car, wherein the improvement comprises: a generally vertically disposed plate secured to the face of each of said side sills facing inwardly of the car generally at each end thereof proximate the securement of at least a portion of said shear plate to said side sill; a rigid one-piece member of a suitable weldable material welded to said plate for rigidly interconnecting said side sill, said shear plate, said bottom, and said side plate, said rigid one-piece member comprising a base having an outside face adapted to be welded to said plate, a body portion inwardly of the base, and a portion extending downwardly from said body portion welded to its respective said side sill and to said bottom, said body portion being welded to said shear plate, said base portion having a curved inner face for at least in part mating with a closure plate, the latter constituting a transition between said side plate and said shear plate.

2. In a center stub sill railroad car as set forth in claim 1 wherein said rigid one-piece member is an integral casting.

3. In a center stub sill railroad car as set forth in claim 1 wherein said rigid one-piece member is a fabricated member.

4. In a center stub sill railroad car as set forth in claim 1 wherein said shear plate has an inner portion extending downwardly relative to the horizontal, and wherein said downwardly extending portion of said shear plate is supported by and welded to said body portion of said rigid one-piece member.

5. In a center stub sill railroad car as set forth in claim 4 wherein said casting is coped in the area proximate the juncture of said body portion and said base for receiving said shear plate.

6. In a center stub sill railroad car as set forth in claim 2 wherein the upper edge of said base portion includes means for permitting the upper edge of said base portion to be readily welded to said plate.

7. In a center stub sill railroad car as set forth in claim 2 wherein said downwardly extending portion has a face thereof facing outwardly of the car for having the lower margin of said side sill welded thereto.

* * * * *